United States Patent [19]

Bonnett

[11] 3,935,977

[45] Feb. 3, 1976

[54] SKI EQUIPMENT CARRIER

[76] Inventor: Robert B. Bonnett, 8618 Robinwood Circle, Utica, Mich. 48087

[22] Filed: Nov. 13, 1974

[21] Appl. No.: 523,648

[52] U.S. Cl...... 224/45 S; 211/60 SK; 280/11.37 K

[51] Int. Cl.²..... B65D 45/04

[58] Field of Search..... 224/45 S, 45 R, 46 R, 50, 224/52, 45 D, 42.1 F, 49; 211/60 SB; 280/11.37 K, 11.37 A

[56] References Cited

UNITED STATES PATENTS

| | | | |
|---|---|---|---|
| 2,133,883 | 10/1938 | Aubert | 280/11.37 A |
| 3,262,619 | 7/1966 | Selnes | 224/50 |
| 3,275,160 | 9/1966 | Zurker | 280/11.37 K |
| 3,643,810 | 2/1972 | Highberger | 224/45 S |
| 3,692,218 | 9/1972 | Friedman | 224/45 T |
| 3,780,920 | 12/1973 | Green | 224/45 S |

*Primary Examiner*—Kenneth H. Betts
*Assistant Examiner*—R. Schrecengost
*Attorney, Agent, or Firm*—Browne, Beveridge, DeGrandi & Kline

[57] ABSTRACT

A ski equipment securing and carrying device including a body portion having a pair of hingedly interconnected cover segments, each cover segment including a ski receiving portion and ski pole receiving portion provided with yieldable members for respective accommodation therewithin of skis of various widths and thicknesses and ski poles of various diameters, the cover segments being hingedly interconnected for closure together with the ski receiving portion and pole receiving portion of one confronting the respective ski receiving portion and pole receiving portion of the other in cooperative relationship for respective clamped engagement of skis and ski poles within the ski and ski pole cavities by the yieldable members thereof. The cover segments may include latch means for fastening them together in a manner to inhibit removal of skis and poles secured therewithin, and elongated fastening elements may be attached thereto for securement thereof to an immovable object such as a tree or ski rack. The ski equipment carrying device may have a one-piece molded body portion which may be formed of polypropylene.

11 Claims, 8 Drawing Figures

FIG. 1
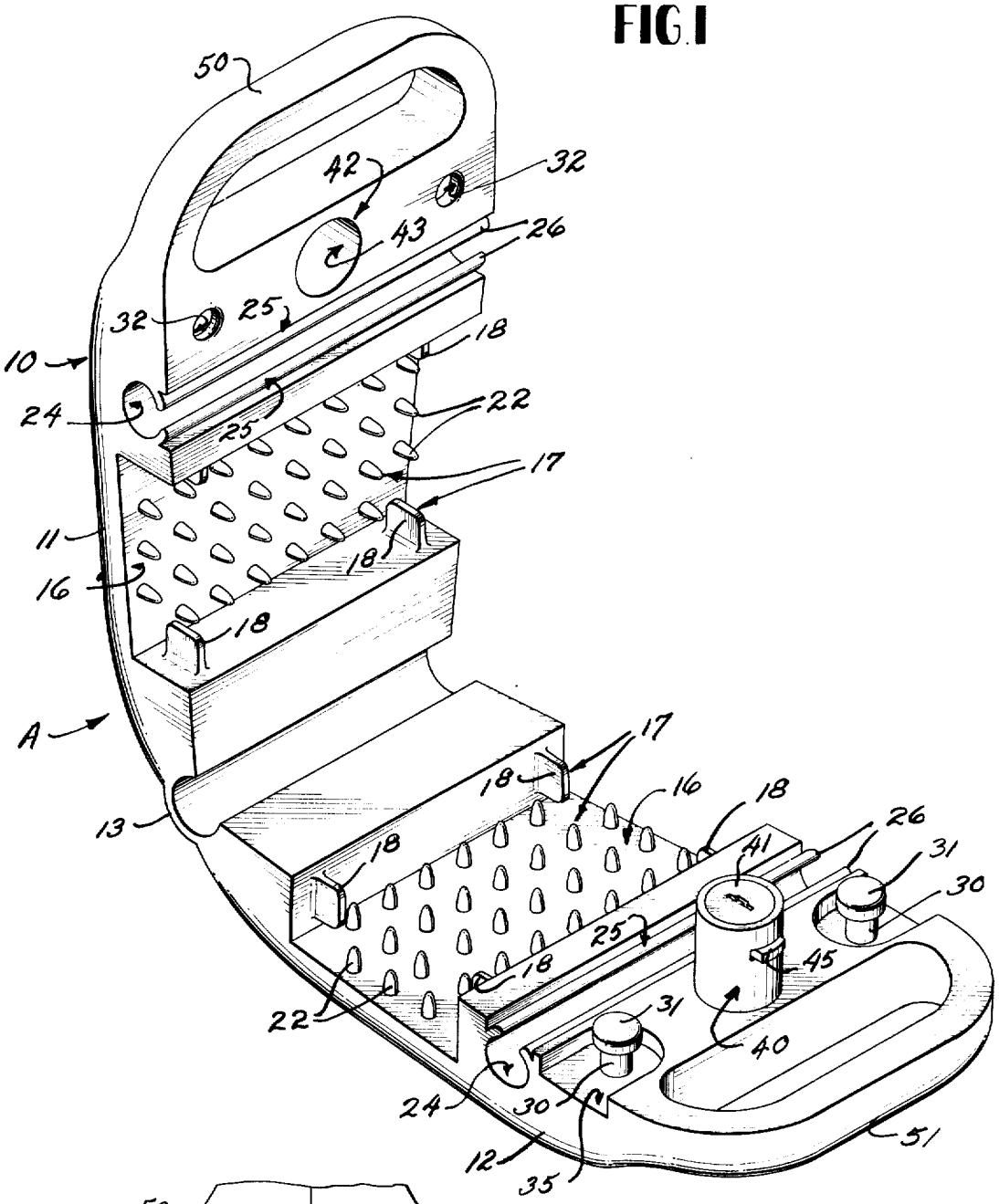
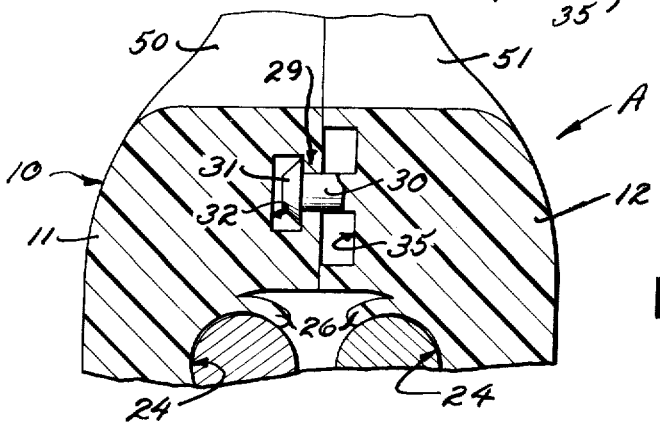
FIG. 4

SKI EQUIPMENT CARRIER

BACKGROUND, FIELD AND OBJECTIVES OF THE INVENTION

This invention generally relates to carriers designed to facilitate the portability of ski equipment by the owner thereof and which may also be employed as a ski equipment securing device to prevent the theft of ski equipment carried thereby.

Skis and ski poles are obviously somewhat unwieldy when they are carried loosely and may be extremely expensive pieces of equipment. Accordingly, the ski enthusiast not only seeks ways for him to carry his equipment with facility, but he also seeks to prevent the theft of his equipment. I recognize that various devices have been previously provided for carrying and securement of ski equipment. However, such previously provided devices have had various shortcomings, not the least of which is that they have usually included multiple separable parts, been extremely expensive, and have been subject to failure in the cold environment in which they are generally used.

This invention is designed to eliminate the undesirable aspects of such previously provided devices. It may, for instance, comprise an integral unit having a one-piece body portion, including a pair of hingedly interconnected polygonal cover segments, and may be molded from polypropylene. Each cover segment may include a ski receiving portion for carrying a single ski and a ski pole receiving portion for carrying a single pole, closure together of the cover segments providing for securement of the skis and ski poles therebetween. The cover segment preferably includes yieldable ski and ski pole retaining members to accommodate various sizes of skis and ski poles. An easily opened latch may be provided for securing the segments together for facile removal of the ski equipment therefrom and a lock to prevent such removal. The same may be provided to accommodate members for securing it to immovable objects such as trees and ski racks.

Other objects and advantages of the invention will become apparent during the following detailed description, taken in connection with the accompanying drawings, and in which drawings:

BRIEF DESCRIPTION OF THE DRAWINGS

FIG. 1 is a perspective view of my improved ski equipment carrier in its open position.

FIG. 4 is a fragmentary sectional view taken substantially along the line 4—4 of FIG. 2.

DETAILED DESCRIPTION

Figure 2:
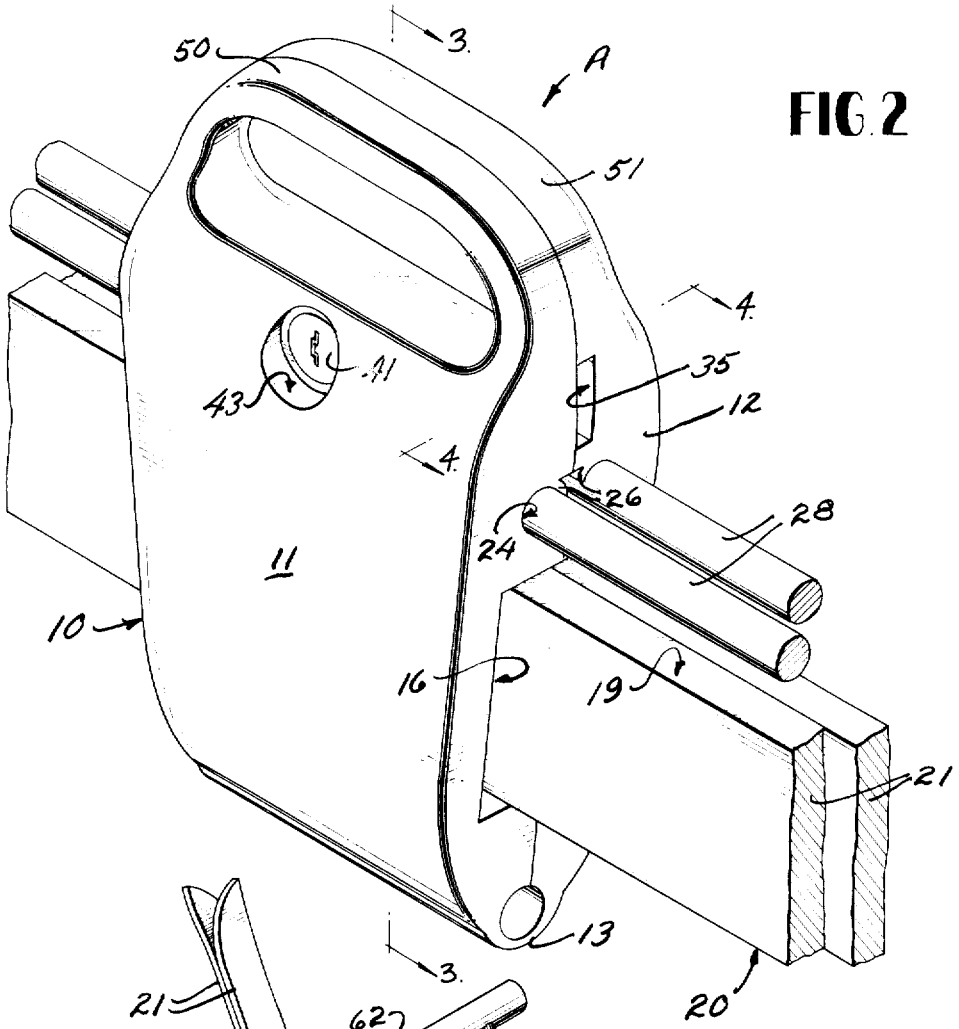
FIG. 2 is a perspective view of the carrier in closed position for carrying a pair of skis and a pair of ski poles.
Figure 5:
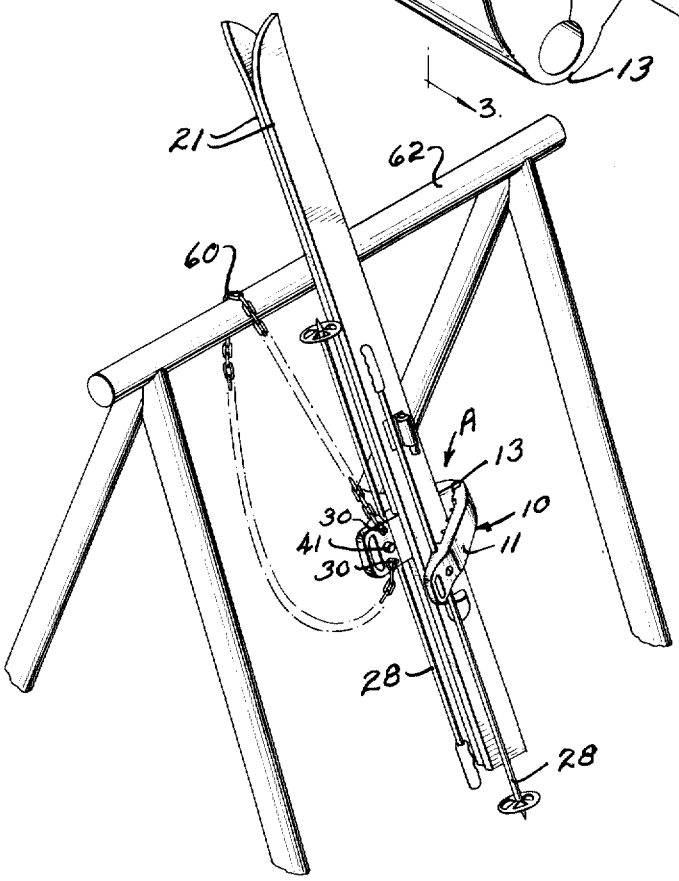
FIG. 5 is a perspective view of the carrier in association with a locking chain by which it could be secured to a ski rack.
Figure 6:
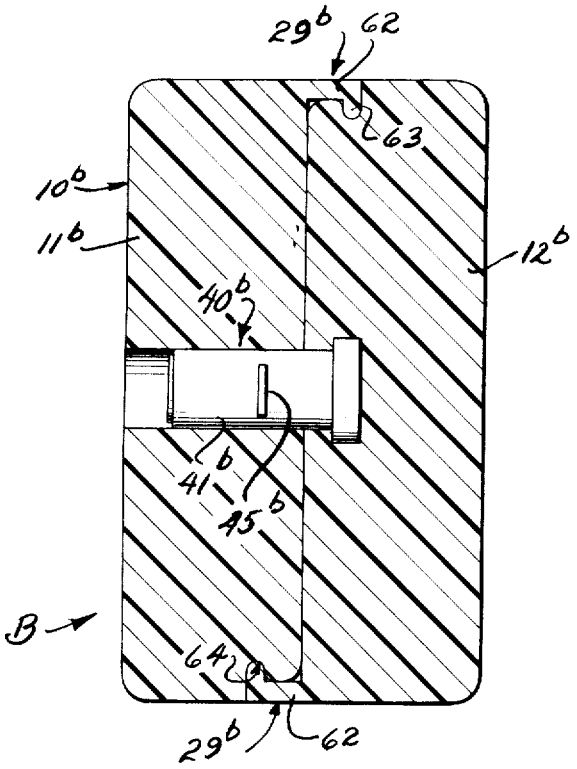
FIG. 6 is a fragmentary sectional view showing a modified latch arrangement for securing the cover segments of the carrier in a closed together position.
Figure 7:
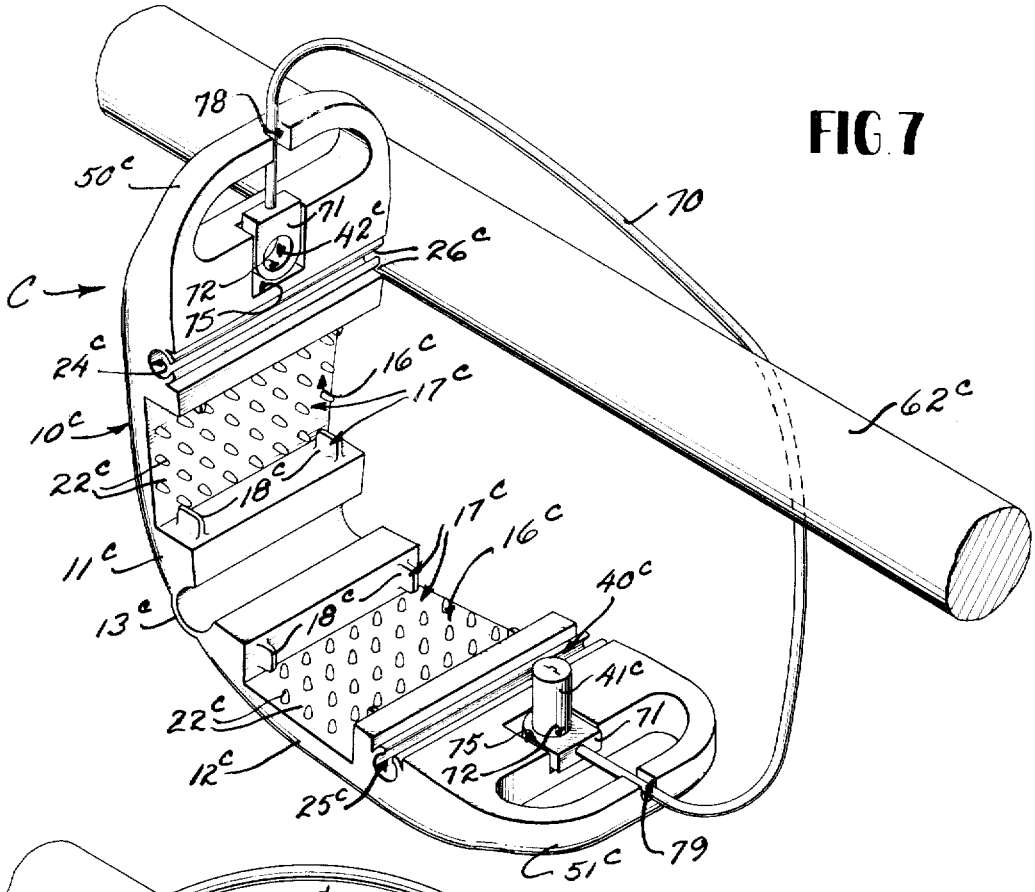
FIG. 7 is a perspective view showing a modified ski equipment carrier and member for securing the same to such as a ski rack.
Figure 8:
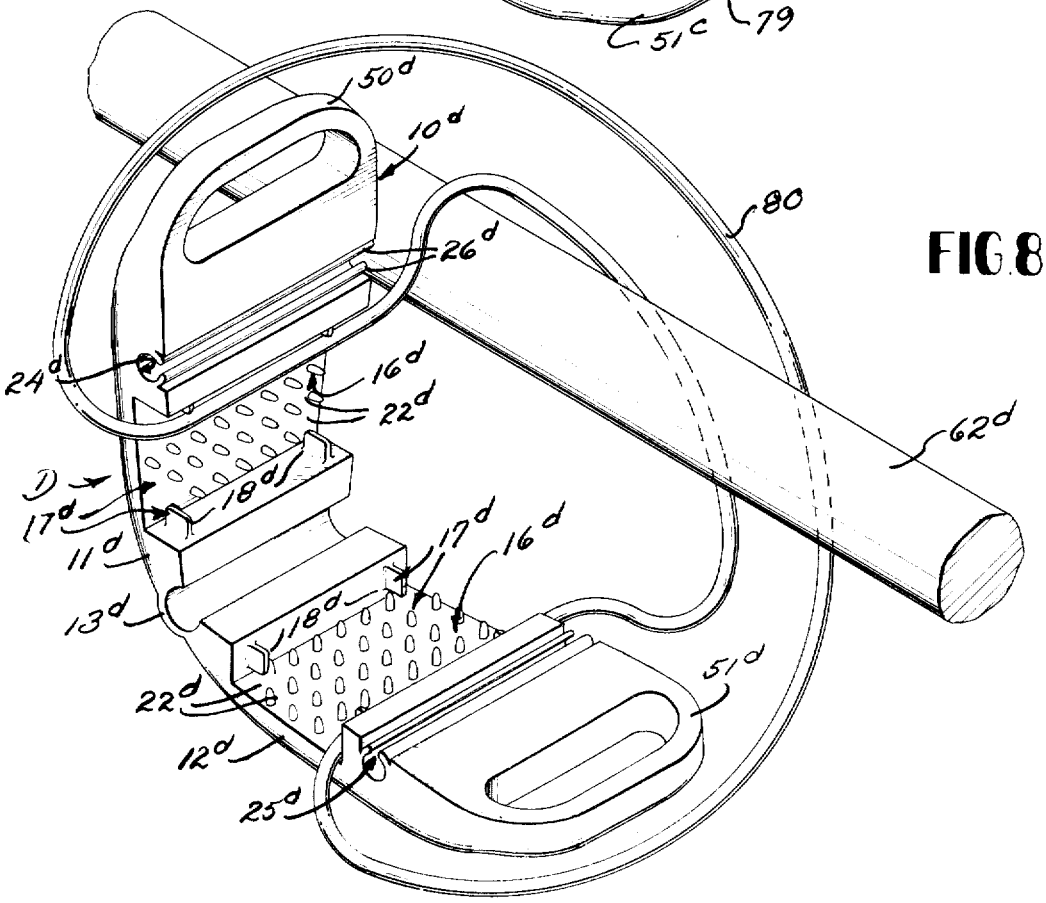
FIG. 8 is a perspective view showing still another modification of my ski equipment carrier and embodying another type of member for securing the same to such as a ski rack.

In the drawings, wherein are shown preferred and modified forms of the invention and wherein similar reference characters designate corresponding parts throughout the several views, the letter A may designate my improved ski equipment securing and carrying device as shown in FIGS. 1–5; B the form as shown in FIG. 6; C the form as shown in FIG. 7; and D the form as shown in FIG. 8.

Ski equipment securing and carrying device A preferably includes a body portion 10 having cover segments 11 and 12 hingedly interconnected as by hinge portion 13. As shown, cover segments 11 and 12 and hinge portion 13 may be formed as an integral unit providing a one-piece molded body portion. Body portion 10 may, for instance, be polypropylene, in which case hinge portion 13 forms what is referred to in the art as a "living hinge" in which repeated hinge action thereof seems to increase its life.

Figure 3:
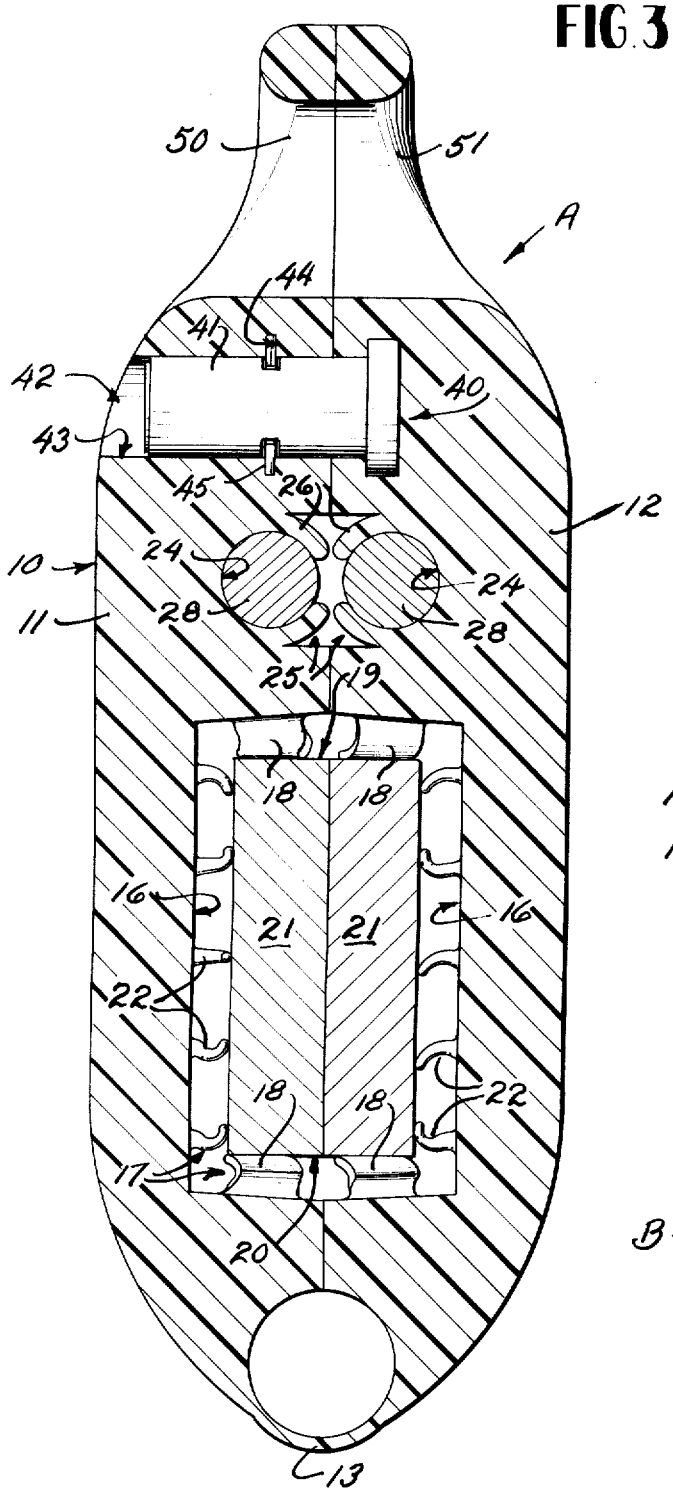
FIG. 3 is a sectional view taken substantially along the line 3—3 of FIG. 2.

Each cover segment 11 and 12 preferably includes a ski receiving portion 16 having a plurality of yieldable members 17 extending thereinto. Yieldable members 17 may comprise a plurality of flexible ribs 18 positioned to engage the sidewalls 19 and 20 of skis 21, as best shown in FIG. 3, and a plurality of flexible nibs 22 which are positioned to engage the innermost face of a ski 21 received within ski receiving portion 16. Since ribs 18 and nibs 22 are flexible, skis of various thickness and width can be received and securely held within ski receiving portion 16.

Each cover segment 11 and 12 also preferably includes a pole receiving portion 24 having yieldable members 25 extending thereinto. Yieldable members 25 may comprise flexible flanges 26 which are positioned to engage and securely hold a ski pole 28 within ski pole receiving portion 24.

Since members 17 and 25 are yieldable, ski equipment carrying and securing device A can be shifted between the bindings of skis 21 received therewithin, for balance, and ski poles 38 may be adjusted longitudinally within pole receiving portions 24 to attain a still more particular balance.

Body portion 10 may include latch means 29 for securing cover segments 11 and 12 together. In form A of the invention, latch means 29 may comprise a pair of tabs 30, mounted on cover segment 12, each of which includes an enlarged head portion 31 which may be snapped into a tab receiving aperture 32 provided in cover segment 11.

Lock means 40 may be provided for securely locking cover segments 11 and 12 together to prevent removal of skis and ski poles from my improved ski equipment carrier. Lock means 40 may include a lock cylinder 41 mounted on cover segment 12, cover segment 11 having a lock receiving means 42 comprising a cylindrical aperture 43 provided with slots 44 which may receive locking lugs 45 of lock cylinder 41.

To facilitate carrying, cover segments 11 and 12 may be respectively provided with a handle portion 50 and 51 which are designed so as to form a single unitary carrying means when the cover segments thereof are closed together.

Skiers frequently find it convenient to leave their ski equipment unattended when they enter a ski lodge. At such times it is desirable to secure the ski equipment to prevent theft thereof. As shown in FIG. 5, an elongated flexible member, which may comprise a chain 60, may be used for securing my improved ski equipment carrier to such as a ski rack 62 in a manner to prevent theft of ski equipment. The end links of chain 60 may be received over tabs 30 for attachment of chain 60 to the ski equipment carrier, areas 35 of cover segment 12 being excised adjacent each tab 30 thereof for receiving chain 60 and facilitating tight closure together of cover segments 11 and 12.

The parts of Forms B, C and D of the invention which correspond to parts of Form A have been respectively designated in the various views by similar reference characters having prime characters *b*, *c* and *d*.

Form B of the invention shows a modified form of latch means $29^b$ for securing cover segments $11^b$ and $12^b$ together. In this form of the invention, latch means $29^b$ may include exterior tabs 62 having inturned outer flanges 63. As shown in FIG. 6, a tab 62 is preferably provided on each cover segment $11^b$ and $12^b$, extending outwardly therefrom and positioned for engagement of lugs 63 thereof within a tab receiving aperture 64 provided in the other cover segment.

Form C of the invention, as shown in FIG. 7, is illustrative of another modified form of my improved ski equipment carrier, illustrating a construction in which lock means $40^c$ is the only medium provided for securing cover segments $11^c$ and $12^c$ together. The area of the cover segments adjacent lock means $40^c$ may also be modified for facile attachment thereto of an elongated flexible member 70. As shown, elongated flexible member 70 may be provided at each end thereof with connector members 71, each of which have a cylindrical aperture 72 therethrough for receiving therewithin lock cylinder $41^c$ in a manner to provide secure attachment of the ends of elongated flexible member 70 to my improved ski equipment carrier. In order to facilitate reception of a connector member 71 by cover segments $11^c$ and $12^c$, an area 75 may be excised adjacent lock means $40^c$ and an area 76 may be excised adjacent lock receiving means $42^c$; and handle portions $50^c$ and $51^c$ may be respectively provided with centrally disposed slots 78 and 79 through which elongated flexible member 70 may extend. Elongated flexible member 70 may be thus attached about a ski rack $62^c$ in a manner to prevent unauthorized use of the ski equipment received by my improved ski equipment carrier.

Form D of the invention is a still further modified form of the invention which shows that it is within the concept of my invention to provide a ski equipment carrier which need not unitarily include positive means for fastening the cover segments thereof together. However, as shown in FIG. 8, if it is desired to secure ski equipment carrier D to such as a ski rack $62^d$, an endless elongated flexible member 80 may be looped through the ski receiving portion 16 of each cover segment $11^d$ and $12^d$, the respective cover segments then being closed together and secured in a closed together position by passing a chain or lock (not shown) about handle portions $50^d$ and $51^d$ thereof.

Various changes may be made to the forms of the invention herein shown and described without departing from the spirit of the invention or the scope of the following claims.

I claim:

1. A ski equipment securing and carrying device including a body portion having a pair of polygonal cover segments, each of said cover segments having a ski receiving portion and a pole receiving portion, each said ski receiving portion being shaped to receive a ski therewithin and each said pole receiving portion being shaped to receive a ski pole therewithin, each said ski receiving portion and said pole receiving portion including yieldable members for respectively engaging a ski and a ski pole, hinge means hingedly interconnecting said cover segments for juxtaposed closure thereof with said ski receiving portion and pole receiving portion of one of said cover segments confronting the ski receiving portion and pole receiving portion of the other of said cover segments in cooperative relationship for respective clamped engagement by said yieldable members of a ski and a ski pole in relatively fixed position within each said ski receiving portion and said pole receiving portion thereof, and latch means for securing said cover segments in a juxtaposed closed relationship, said latch means comprising tab means positioned interiorly within one of said cover segments and tab means receiving aperture means opening interiorly of the other of said cover segments.

2. A ski equipment securing and carrying device as specified in claim 1 including an elongated flexible member having apertured ends shaped to fit over said tab means.

3. A ski equipment securing and carrying device including a body portion having a pair of polygonal cover segments, each of said cover segments having a ski receiving portion and a pole receiving portion, each said ski receiving portion being shaped to receive a ski therewithin and each said pole receiving portion being shaped to receive a ski pole therewithin, each said ski receiving portion and said pole receiving portion including yieldable members for respectively engaging a ski and a ski pole, hinge means hingedly interconnecting said cover segments for juxtaposed closure thereof with said ski receiving portion and pole receiving portion of one of said cover segments confronting the ski receiving portion and pole receiving portion of the other of said cover segments in cooperative relationship for respective clamp engagement by said yieldable members of a ski and a ski pole in relatively fixed position within each said ski receiving portion and said pole receiving portion thereof, latch means for securing said cover segments in a juxtaposed closed relationship, lock means mounted on and extending from one of said cover segments, the other of said cover segments having lock receiving means positioned for receiving said lock means therewithin in providing locked closure together of said cover segments, and an elongated flexible member having apertured ends shaped to fit over said lock means.

4. A ski equipment securing and carrying device including a body portion having a pair of polygonal cover segments, each of said cover segments having a ski receiving portion and a pole receiving portion, each said ski receiving portion being shaped to receive a ski therewithin and each said pole receiving portion being shaped to receive a ski pole therewithin, each said ski receiving portion and said pole receiving portion including yieldable members for respectively engaging a ski and a ski pole, hinge means hingedly interconnecting said cover segments for juxtaposed closure thereof with said ski receiving portion and said pole receiving portion of one of said cover segments confronting the ski receiving portion and pole receiving portion of the other of said cover segments in cooperative relationship for respective clamp engagement by said yieldable members of a ski and a ski pole in relatively fixed position within each said ski receiving portion and said pole receiving portion thereof, latch means for securing said cover segments in a juxtaposed closed relationship, lock means mounted on and extending from one of said cover segments, the other of said cover segments having lock receiving means positioned for receiving said lock means therewithin in providing locked closure together of said cover segments, and an endless elongated flexible member, said endless flexible member being positioned to extend through a ski receiving portion of at least one of said cover segments and providing a loop extending outwardly from said body portion for securement thereof to such as at least relatively fixed objects as will inhibit portability of the ski equipment securing and carrying device.

5. A ski equipment securing and carrying device comprising a one-piece molded body portion including: a pair of polygonal cover segments, each of said cover segments having a ski clamping portion, a ski pole clamping portion and a handle portion, each of said ski clamping portions comprising a ski receiving cavity having a plurality of flexible nibs extending thereinto in juxtaposition to engage a surface of the ski received therewithin, each said ski pole clamping portion comprising a pole receiving cavity having shaped pole engaging flanges extending thereinto and positioned to flexibly engage a ski pole, said handle portion of each said cover segments being shaped to form a single carrying means when said cover segments are closed together, and hinge means hingedly interconnecting said cover segments for juxtaposed closure thereof with said ski receiving portion and a pole receiving portion of one of said cover segments confronting the ski receiving portion and pole receiving portion of the other of said cover segments in cooperative relationship for securement therewithin of skis and ski poles.

6. A ski equipment securing and carrying device as specified in claim 5 wherein said body portion is formed of polypropylene.

7. A ski equipment securing and carrying device including a body portion having a pair of substantially polygonal cover segments, each of said cover segments having a ski receiving recessed portion and a pole receiving recessed portion, each said ski receiving recessed portion being shaped to receive a ski therewithin and each said pole receiving recessed portion being shaped to receive a ski pole therewithin, each said ski receiving recessed portion including yieldable means positioned for engaging the side edges of a ski received within said ski receiving recessed portion in snug accommodation therewithin of skis of various width, each said pole receiving recessed portion including yieldable means for substantial clamping engagement therewithin of a ski pole, and hinge means hingedly interconnecting said cover segments for juxtaposed closure thereof with said ski receiving recessed portion and said pole receiving recessed portion of one of said cover segments confronting the ski receiving recessed portion and pole receiving recessed portion of the other of said cover segments, each said ski receiving recessed portion having yieldable members positioned therewith for engagement of a face of a ski on closure together of said cover segments in a cooperative relationship for clamped engagement by said yieldable members of a ski pole in relatively fixed position within said pole receiving recessed portion thereof and said yieldable members of each said ski receiving recessed portion each engage a face of a ski received therewithin so that skis of various thickness may be accommodated by the ski equipment securing and carrying device.

8. A ski equipment securing and carrying device as specified in claim 7 wherein said yieldable means of said ski receiving recessed portion comprises a plurality of ribs extending into said ski receiving recessed portion from opposed ends of said ski receiving recessed portion.

9. A ski equipment securing and carrying device as specified in claim 7 wherein said yieldable members of said ski receiving recessed portion comprises a plurality of flexible nibs extending into said ski receiving recessed cavity in juxtaposition to engage the face of a ski received therewithin.

10. A ski equipment securing and carrying device as specified in claim 7 wherein said yieldable means of said ski receiving recessed portion comprises a plurality of ribs extending into said ski receiving recessed portion from opposed ends of said ski receiving recessed portion and said member of said ski receiving recessed portion comprises a plurality of flexible nibs extending into said ski receiving recessed cavity in juxtaposition to engage the face of a ski received therewithin.

11. A ski equipment securing and carrying device as specified in claim 7 wherein said yieldable means of each said pole receiving recessed portion comprises shaped pole engaging flanges extending into said pole receiving recessed portion in juxtaposition to engage and clamp a ski pole received therewithin.

* * * * *